US006541743B2

(12) United States Patent
Chen

(10) Patent No.: US 6,541,743 B2
(45) Date of Patent: Apr. 1, 2003

(54) ELECTRICAL HEATER UNIT AND HEATER

(76) Inventor: Steve Chen, Rm. 907, 9/F Technology Park, 18 on Lai St., Siu Lek Yuen, Shatin, New Territories, Hong Kong (HK)

( * ) Notice: Subject to any disclaimer, the term of this patent is extended or adjusted under 35 U.S.C. 154(b) by 0 days.

(21) Appl. No.: 09/782,940

(22) Filed: Feb. 14, 2001

(65) Prior Publication Data

US 2002/0108943 A1 Aug. 15, 2002

(51) Int. Cl.[7] ..... H05B 3/50
(52) U.S. Cl. ..... 219/530; 219/540; 392/343; 392/347
(58) Field of Search ..... 219/530, 540, 219/258; 392/343, 347, 358, 360, 370, 374, 377

(56) References Cited

U.S. PATENT DOCUMENTS 4,042,901 A * 8/1977 Bechtel ..... 29/612
4,124,794 A * 11/1978 Eder ..... 219/530
4,567,351 A * 1/1986 Kitagawa et al. ..... 126/101
5,721,804 A * 2/1998 Greene, III ..... 126/101
5,963,708 A * 10/1999 Wong ..... 122/488
6,072,938 A * 6/2000 Peterson et al. ..... 392/343

FOREIGN PATENT DOCUMENTS

FR 2390066 * 1/1979

* cited by examiner

*Primary Examiner*—Teresa Walberg
*Assistant Examiner*—Vinod D. Patel
(74) *Attorney, Agent, or Firm*—Ladas & Parry

(57) ABSTRACT

A safe electrical heat energy generator which comprises a heater unit equipped with a set of systematically organized heat radiating metal fins. A feature of the invention is its reenforced compact structure in which a heating element arrangement and the heat radiating metal fin arrangement are manufactured as a single heater unit structure. In such a structure, a heating element is surrounded with an insulating layer and enclosed inside a central heat conductive tubing of the framework for the metal fin arrangement, thereby defining the major components of the heater unit. In this manner, the entire heater unit structure is the source of radiant heat energy, not simply the heating element itself.

22 Claims, 3 Drawing Sheets

ELECTRICAL HEATER UNIT AND HEATER

BACKGROUND OF THE INVENTION

1. Field of the Invention

This invention relates to the field of electric heaters, and more particularly to an electric heater having improved heating efficiency and safety aspects, and implemented as a reenforced compact structure.

2. Brief Description of the Prior Art

A variety of heaters are available on the current market, such as oil burning heaters, electric fan heaters, quartz heaters, convection heaters with round heating elements, PTC (ceramic) heaters, etc. Apart from oil burning heaters, all the others release radiant heat energy directly from infrared heating elements. Such heating elements can provide fast creation of heat, but also increase the danger of fire or electric shock.

Electric heaters of the prior art generally are constructed with an exposed glow bar or wire which produces all of the radiant heat of the heater, the glow bar or wire being mounted in the heater behind a grating or wire screen through which the radiant heat energy passes into the environment.

In some such prior art heaters, heat reflecting panels redirect rearwardly directed radiant heat energy back toward the front of the heater. In others, a fan is installed in the heater behind the glow bar or wire to force hot air in the vicinity of the heating element toward the front of the heater through the grating or wire screen.

In all such prior art heaters, there exists a very hot region in the vicinity of the heating element, increasing the risk of fire if the heater is tipped over or if a combustible material, such as a curtain, is drawn into contact or near contact with the heating element. Such heater construction also increases the risk of being shocked or even electrocuted by accidentally touching the heater element through the grating or wire screen.

Other characteristics of prior art heaters are problematical, such as having low to medium heat transfer rate, being structurally fragile, having unsafe (infrared) surface conditions, having a short life, having high surface temperatures (some greater than 600° C.), having poor insulation characteristics, and being subject to damage by exposure to water.

SUMMARY OF THE INVENTION

The present invention provides a comprehensive and rational solution to the problems associated with prior art heaters and heater elements, while still retaining a very high level of conductivity of heat energy in a safe manner.

A heater constructed according to the present invention represents a safe electrical heat energy generator which comprises a heater unit equipped a set of systematically organized heat radiating metal fins. An important feature of the invention is its reenforced compact structure in which a heating element and the heat radiating metal fin arrangement are manufactured as a single heater unit structure.

In such a structure, a heating element is surrounded with an insulating layer and enclosed inside a central heat conductive tubing of the framework for the metal fin arrangement, thereby defining the major components of the heater unit. In this manner, the entire heater unit structure is the source of radiant heat energy, not simply the heating element itself.

That is, the heating element, confined within the central heat conductive tubing, transfers heat to the interior surface of the tubing which, in turn transfers heat to the arrangement of spaced heat radiating metal fins, thereby increasing the amount of heat release due to the large surface area of the plurality of spaced metal fins. The gaps between the metal fins enforce movement of air currents and thus heat the surrounding air efficiently and uniformly.

Because the electrical current of the system is confined to the heating element enclosed in a central heat conductive tube, there is no risk of getting shocked by touching the heater unit, since no current carrying elements are exposed.

Additionally, due to the combined large area of heat radiating surfaces and the uniform distribution of radiant heat from the heater unit by the arrangement of heat radiating metal fins, there are no hot spots along the entire extent of the heater unit which would cause igniting of objects in the near vicinity of the heater unit or even objects touching the heater unit fin structure.

Compared with other heater appliances on the market, the heater unit of the present invention effectively reduces the risk of fire and electric shock.

As to the application of the invention, the heater unit can be used as a direct heat energy generator, or as the heat energy provider for any other kind of appliance requiring a radiant heat energy source.

In a broad sense, the present invention overcomes the aforementioned negative attributes of prior art heaters by providing a compactly constructed unique heat distribution system to reduce excessive hot spots or regions in the heater, while producing efficient, safe, and uniform heat radiation into the environment, e.g., a room.

In accordance with one aspect of the invention, there is provided a heater comprising: a housing; a heater unit fixedly mounted in the housing, the heater unit comprising means for radiating heat into the environment about the heater unit; and a heating element arrangement confined within the heater unit.

In another aspect of the invention, there is provided a heater unit for use in an electric heater, comprising: a heat conductive tube having an interior surface and an exterior surface; an electrical heating element arrangement contained within, and in thermal contact with, the interior surface of the heat conductive tube; and a plurality of heat radiating fins arranged along, and in thermal contact with, the exterior surface of the heat conductive tube.

Variations of physical construction parameters are possible without departing from the basic concepts of the present invention. For example, instead of providing a single central heat conductive tube, a plurality of such tubes may be provided, and additional metal fins may be provided to interconnect the plurality of tubes for improved heat radiation and distribution.

Various geometric shapes for the overall configuration of the heater unit are likewise possible, the preferred configuration being an elongated linear central heat conductive tube, or tubes, from which two sets of thin, spaced apart metal fins extend in a V shape as viewed from one end of the heater unit, the fins making an angle of approximately 90 degrees.

It is to be understood that any number of central heat conductive tubes can be employed, any shape for the heat conductive tube(s) including curved and angled shapes, and any number of heat radiating metal fin arrangements can be fitted to associated heat conductive tubes, and any overall geometrical shape and cross section for the heater unit, or units, are possible, consistent with the improved heater and heater unit concepts and aspects according to the present invention.

Compared with prior art heaters of similar usage, the heater, or heater unit, of the present invention exhibits a number of advantages:

a. a high heat transfer rate, due to the choice of materials, construction design, and large surface area for heat radiation;

b. mechanically very robust, due to unitary, single cast construction;

c. a safe surface condition, due to full confinement of electrical heating element, and uniform heat distribution with the aid of one or more heat radiating metal fin arrangements maintaining surface temperatures to under 400° C.;

d. a relatively long life, due to protection of a confined heating element from excessive oxidation and inadvertent mechanical damage by the user;

e. excellent insulation characteristics, due to the use of a heating element arrangement which includes a heater element, insulation surrounding the heating element, and a heat conductive body surrounding the insulation; and f. highly water resistant, due to inaccessibility of the heating element through which current flows to produce heat energy.

BRIEF DESCRIPTION OF THE DRAWING

Further objects and advantages and a better understanding of the present invention may be had by reference to the following detailed description taken in conjunction with the accompanying drawings in which certain figures are lined for color or texture, and in which.

DEFINITIONS

For the purposes of this description, the following definitions are provided.

"Heater" is used to indicate a complete heat generating system such as would be suitable to warm a room, and includes a housing, at least one heater unit with its associated heating element, and electrical interconnections allowing the heating element to by activated by plugging an associated power cord into a power outlet.

"Heater unit" is defined as the basic heat radiating apparatus that is mounted in the housing of a heater, and comprises a heating element arrangement confined within a heat conductive tube, and a heat radiating fin arrangement in thermal contact with the heat conductive tube.

"Heating element" is defined as the electrical heat source, which may be a wire or rod heated by the passage of electrical current therethrough.

"Heating element arrangement", as used herein, includes a heater element, insulation surrounding the heating element, and a heat conductive tubular member surrounding the insulation. The heat conductive tube and heat radiating fin arrangement are cast around the preassembled heating element arrangement.

DETAILED DESCRIPTION OF THE PREFERRED EMBODIMENTS

Figure 1:
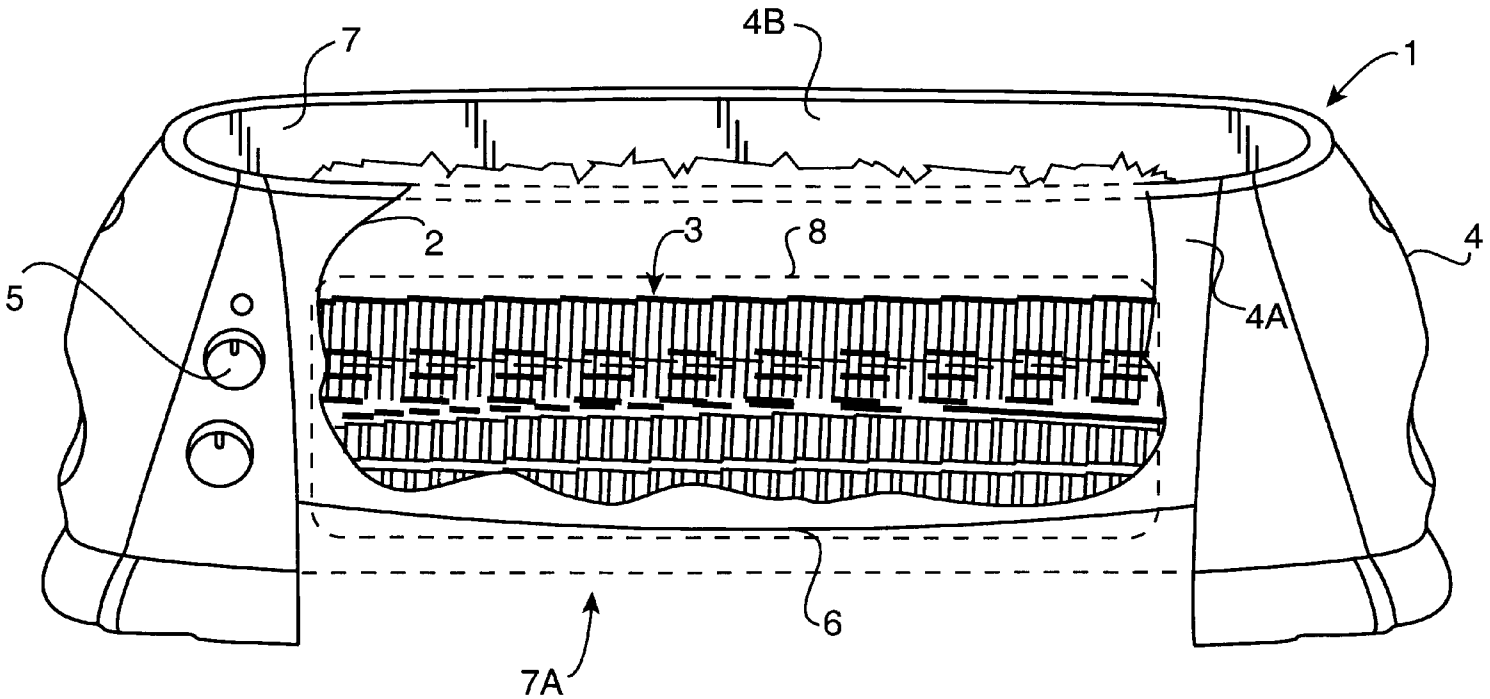
FIG. 1 is a front perspective view of a heater having a cutaway portion exposing a heating unit made in accordance with the present invention.

FIG. 1 is a front perspective view of a heater 1 having a cutaway portion 2 in a housing 4 exposing a heating unit 3 made in accordance with the present invention. The heating unit 3 is fixedly mounted within the housing 4 by any appropriate mounting hardware (not shown). In this embodiment of the invention, the housing 4 has an opening 7 in the top side of housing 4 through which heated air passes upwardly, from a bottom opening 7A, through one or more installed heater units 3, and out top side opening 7.

It will be understood that, as an optional construction, instead of, or in addition to, a top side opening 7, the housing 4 may have at least one sidewall opening 8 (optionally shown in FIG. 1 in dashed lines on a front sidewall 4A, a mirror image of sidewall opening 8 being provided on a rear sidewall 4B) for horizontal air current flow. The invention is not limited to any overall physical design or to any placement of, or number of, openings through which air currents can flow past an internal heater unit or units 3.

The housing 4 is open (opening not visible in FIG. 1) at the bottom 6 which is elevated above the surface upon which the heater 1 is placed, thereby permitting continuous and unobstructed air currents to be drawn into the opening 7A in housing bottom 6, through the heater unit 3, and out the top opening 7 (or, optionally, the sidewall opening, or openings, 8, or any combination of such openings).

Operating controls and indicators are provided, as represented by knob 5, which operating controls and indicators function similarly to those of conventional electric heaters.

Figure 2:
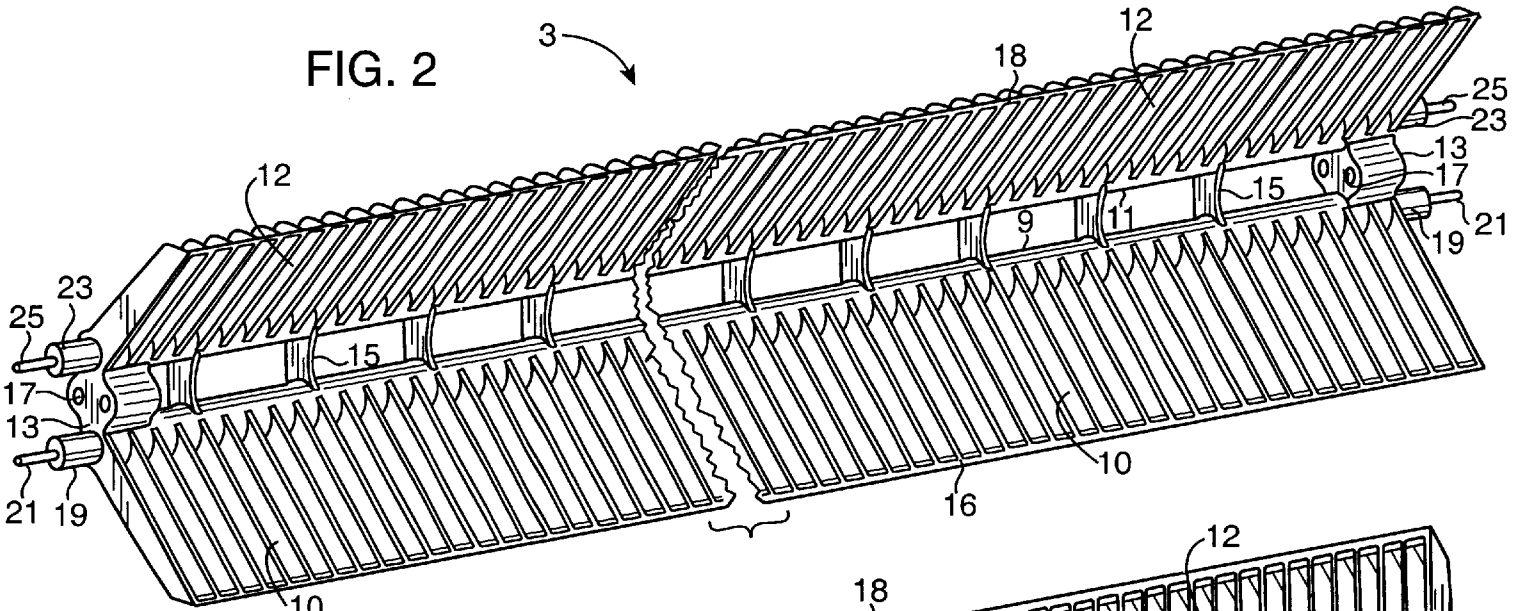
FIG. 2 is a perspective view of a heating unit constructed in accordance with the present invention, the view taken looking into the V-shaped configuration according to a preferred embodiment of the present invention.

FIG. 2 is a perspective view of a heating unit 3 constructed in accordance with the present invention, the view taken looking into the V-shaped configuration according to a preferred embodiment of the present invention.

Figure 3:
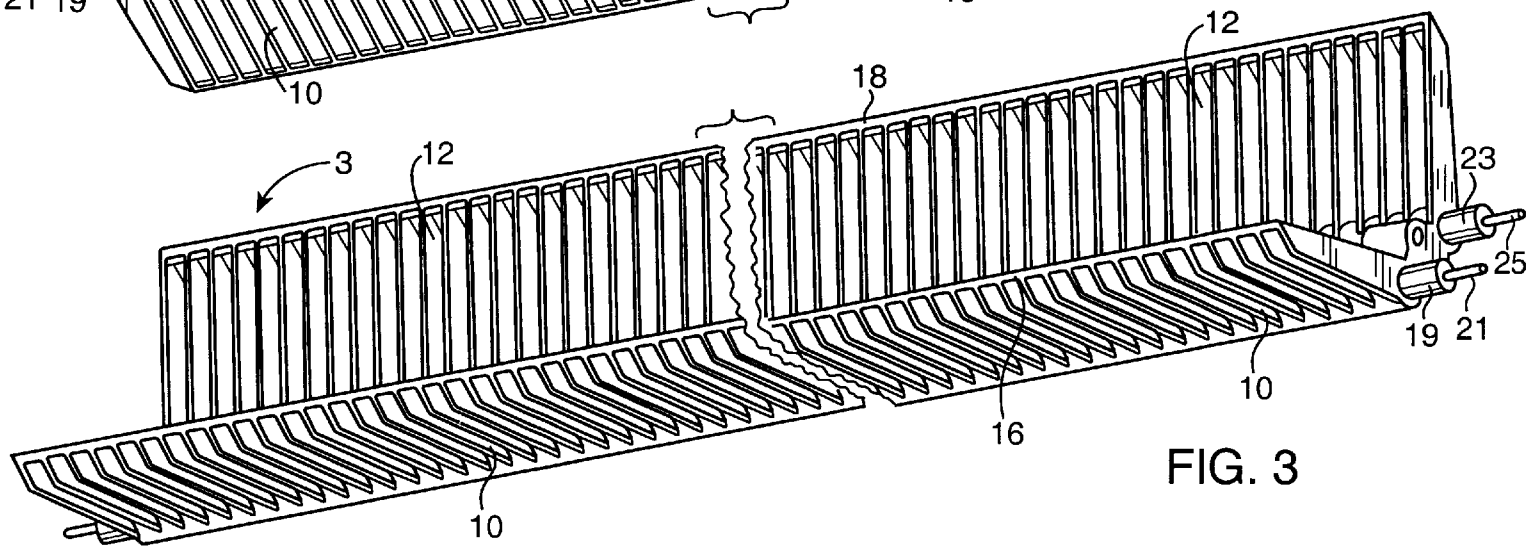
FIG. 3 is a perspective view of the heating unit shown in FIG. 2, but from a different angle to show the structure of the heater unit on the exterior side of the V-shaped configuration.

FIG. 3 is another perspective view of the heating unit 3 shown in FIG. 2. Each of FIGS. 2 and 3 depicts the heating unit 3 from a different angle to show the structure of the heater unit 3 on the interior and exterior sides of the V-shaped configuration, as well as to show the opposite ends of the heater unit 3.

Figure 4:
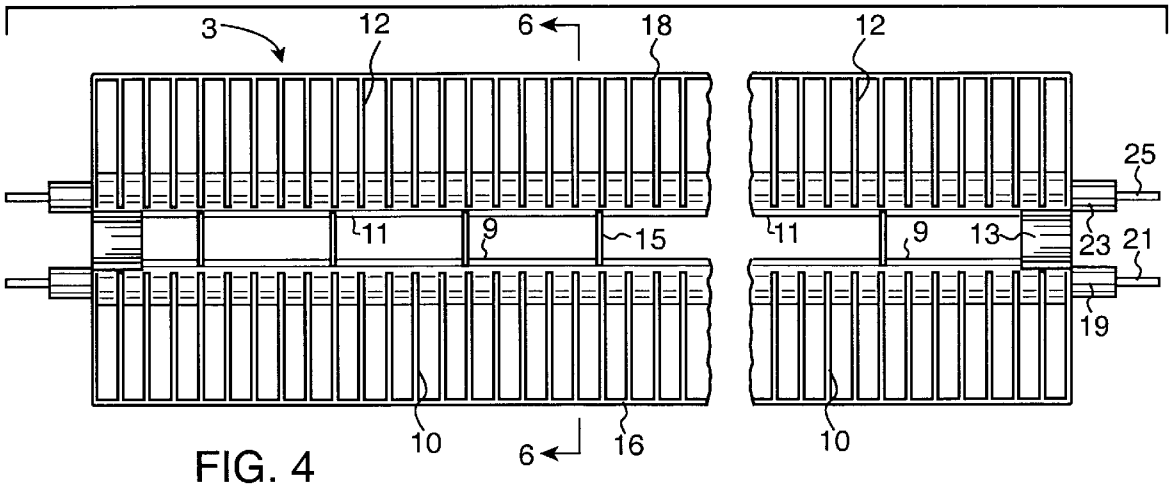
FIG. 4 is a top plan view of the heating unit shown in FIGS. 2 and 3.
Figure 5:
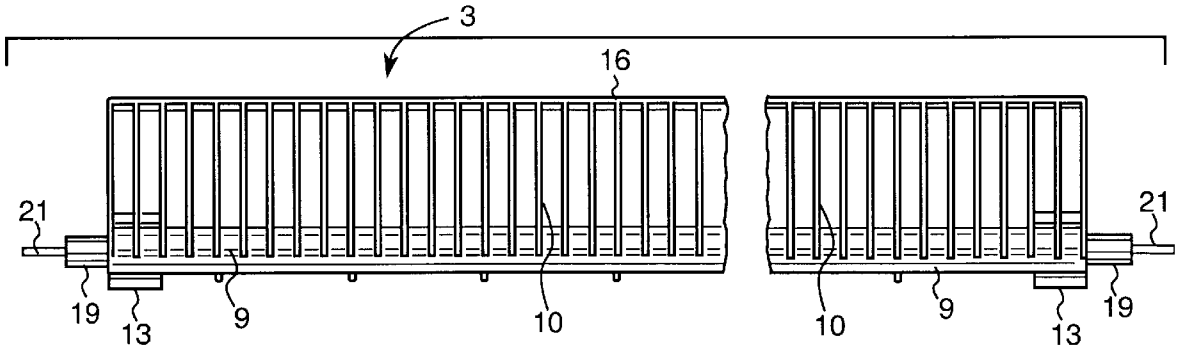
FIG. 5 is a side elevational view of the heater unit shown in FIGS. 2 and 3.

FIGS. 4 and 5 show, respectively, a top plan view and a side elevational view of the heating unit 3 shown in FIGS. 2 and 3.

As seen in FIGS. 2–5, the heater unit 3, according to a preferred embodiment, comprises means 9–12,13,15,16,18 for radiating heat into the environment about the heater unit 3, and a heating element arrangement 19 (FIG. 6) confined within each heat conductive tube 9,11 of the heater unit 3.

Electrical connections to the heating element 22 (see FIG. 7) are made through contact pins 21,25 at each end of the heater unit 3. In the embodiment of the invention shown in the figures, a pair of heating elements 22 are employed, one electrically connected to contact pins 21 and another electrically connected to contact pins 25. Series or parallel connection of the two sets of contact pins 21,25 is left to the discretion of the designer and need not be addressed in this specification.

The means 9–12,13,15,16,18 for radiating heat comprises at least one heat conductive tube 9,11 and a plurality of heat radiating fins 10,12 in thermal contact with respective heat conductive tubes 9,11, a heating element arrangement 19 (FIG. 6) being confined within each heat conductive tube 9,11.

When a pair of heat conductive tubes 9,11 are used, as is the case of the preferred embodiment shown in the figures, additional heat radiating metal fins 15 are provided to interconnect the two heat conductive tubes 9,11, thereby increasing heat transfer throughout the heater unit 3 between the two heat conductive tubes 9,11, as well as providing additional heat transfer to air passing through the space between the two heat conductive tubes 9,11. The number of heat radiating connecting fins 15 can be greater than shown in the figures, and advantageously are the same in number as the number of heat radiating fins 10,12.

Figure 6:
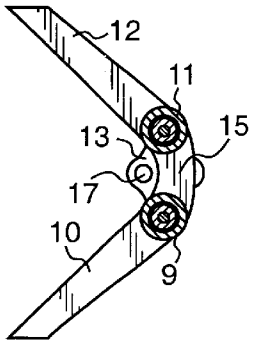
FIG. 6 is a cross sectional view of the heater unit taken along the line 6—6 in FIG. 4.

The preferred embodiment of the heater unit 3 shown in the figures is of elongated V-shape, and the heat radiating fins 10,12 are constructed as a plurality of relatively thin systematically arranged heat radiating elongated flat metal parallel bars, as best seen in FIG. 6 which is a cross sectional view of the heater unit 3 taken along the line 6—6 in FIG. 4.

For a structurally strong and rigid construction, metal end strips 16,18 connect the ends of fins 10,12, respectively, and also serve as yet additional metallic heat radiating surfaces. In a preferred embodiment of the invention, the heat conductive tubes 9,11, the heat radiating fins 10,12, the heat radiating connecting fins 15, and reinforcement end blocks 13 are of unitary, single die cast construction. These elements of the invention are cast around a central heating element arrangement to be described hereinafter in connection with FIG. 7.

By die casting these elements of the invention, a very compact structural design results, with ample structural reinforcements, such as end blocks 13, connecting fins 15, and the metal end strips 16,18 joining the tips of the set of systematically organized heat radiating metal fins 10,12. Importantly, the casting process eliminates the need for expensive time consuming hand assembly of the component parts of the heater unit 3.

The openings 17 formed in reinforcement end blocks 13 may be internally threaded to accept mounting screws (not shown) inserted through aligned holes (not shown) in the framework or panel structure of the housing 4.

As shown in the figures, a preferred configuration of the heater unit 3 has first and second pluralities of heat radiating fins 10,12 extend away from their respective heat conductive tubes 9,11 to form an angle of approximately 90 degrees with respect to one another, thereby defining a generally V-shaped side profile.

Figure 7:
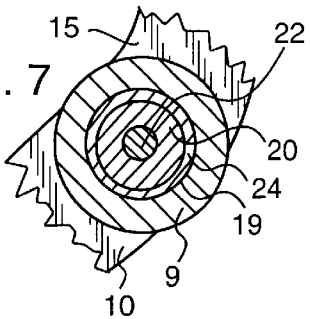
FIG. 7 is an enlarged view of a portion of FIG. 6, showing, in cross section, the internal construction of one of the heat conductive tubes.

With reference to FIG. 7, which is an enlarged view of a portion of FIG. 6, showing, in cross section, the internal construction of one of the heat conductive tubes 9,11, it will be observed that the heat conductive tube 9 encloses a heat conductive tubular member 24, preferably made of copper or brass, which encloses insulation 20, preferably of ceramic material, which surrounds the heating element 22. The heat conductive tubular member 24, insulation 20, and heating element 22 may be referred to herein as a heating element arrangement 19.

In a method of producing the heater unit 3, there is provided a preassembled heating element arrangement 19 which is held in place while the heat radiating elements 9–12,13,15,16,18 are die cast around the heating element arrangement 19. After hardening of the cast components, a compact unitary heater unit 3 results having excellent heat transfer characteristics between the heating element arrangement 19 and the heat radiating elements 9–12,13,15,16,18.

The insulation 20 may be of any suitable high temperature insulating material, such as ceramic. Ceramic insulation is preferred, since it is structurally robust and can withstand high temperatures without significant degradation over time. Moreover, ceramic itself can, when heated, sustain a significant amount of infrared heat radiation.

While only a single embodiment has been set forth herein, alternative embodiments and various modifications will be apparent from the above description to those skilled in the art.

For example, although the embodiment of the invention shown in the figures provides a linear V-shaped configuration for the heater unit 3, it will be appreciated that the heater unit 3 may be implemented by employing a virtually limitless number of configurations, shapes, and designs.

The heat conductive tube or tubes 9,11 may be rectangular, oval, or polygonal in cross section; the heat conductive tube or tubes 9,11 may be bent into curved, angular, or any shape suitable to fit within a similarly configured housing 4; the fins 10,12 may be of any shape, thickness, and length, preferably consistent with good heat radiation patterns and air flow parameters; and the number of heat conductive tubes 9,11 and associated heat radiating fin arrangements 10,12,15 may be greater than the number shown and described herein.

These and other variations, and combinations of shapes and configurations, are possible and presumed to be within the teaching of the present invention.

What is claimed is:

1. A unitary cast heater unit for use in an electric heater, comprising:

an elongated heat conductive tube;

an elongated electrical heating element arrangement contained within said heat conductive tube; and a plurality of heat radiating fins integrally cast with said heat conductive tube.

2. The unitary cast heater unit as claimed in claim 1, wherein said heating element arrangement comprises:

an elongated heat conductive tubular member having an interior surface and an exterior surface;

an elongated heating element contained within said heat conductive tubular member; and insulation between said heating element and said interior surface of said heat conductive tubular member.

3. The unitary cast heater unit as claimed in claim 1, wherein:

said exterior surface of said heat conductive tubular member is in thermal contact with the interior of said heat conductive tube.

4. The unitary cast heater unit as claimed in claim 1, wherein:

said heat radiating fins are constructed as a plurality of systematically arranged heat radiating elongated flat metal parallel bars.

5. The unitary cast heater unit as claimed in claim 4, wherein said elongated fins extend from said heat conductive tube to respective fin tips, and said heater unit further comprises:

an integrally formed heat conductive end strip joining said tips of said set of systematically organized heat radiating fins.

6. The unitary cast heater unit as claimed in claim 1, wherein:

said heat conductive tube, said heat radiating fins, and said heating element arrangement are of unitary, single cast, construction.

7. The unitary cast heater unit as claimed in claim 1, wherein said heat conductive tube defines a first heat conductive tube, said plurality of heat radiating fins defines a first plurality of heat radiating fins, said heat element arrangement defines a first heat element arrangement, and said heater unit comprises:

a second elongated heat conductive tube;

a second plurality of heat radiating fins integrally cast with said second heat conductive tube; and a second elongated electrical heating element arrangement contained within, and in thermal contact with, the interior of said second heat conductive tube.

8. The unitary cast heater unit as claimed in claim 7, comprising:

a plurality of spaced apart heat radiating connecting fins extending between and in thermal contact with each of said first and second conductive tubes.

9. The unitary cast heater unit as claimed in claim 8, wherein:

said heat conductive tubes, said heat radiating fins, said heating element arrangement, and said heat radiating connecting fins are of unitary, single cast, construction.

10. The unitary cast heater unit as claimed in claim 7, wherein:

said first and second pluralities of heat radiating fins extend away from their respective heat conductive tubes to form an angle with respect to one another, thereby defining a generally V-shaped profile.

11. A heater comprising:

a housing;

a unitary cast heater unit fixedly mounted in said housing, said unitary cast heater unit comprising means for radiating heat into the environment about said heater unit; and a heating element arrangement confined within said unitary cast heater unit.

12. The heater as claimed in claim 11, wherein said means for radiating heat into the environment comprises:

a heat conductive tube; and a plurality of heat radiating fins integrally cast and in thermal contact with said heat conductive tube.

13. The heater as claimed in claim 12, wherein:

said heat radiating fins are constructed as a plurality of systematically arranged heat radiating flat metal parallel bars.

14. The heater as claimed in claim 13, wherein:

said heat conductive tube, said heat radiating fins, and said heating element arrangement are of unitary, single cast, construction.

15. The heater as claimed in claim 12, wherein:

said heating element arrangement comprises a heating element and insulation surrounding said heating element.

16. The heater as claimed in claim 15, wherein:

said heat conductive tube has an interior surface and an exterior surface; and said heating element arrangement comprises a heat conductive tubular member enclosing said insulation surrounding said heating element, said heat conductive tubular member having an outer surface in thermal air free contact with said interior surface of said heat conductive tube.

17. The heater as claimed in claim 16, wherein:

said housing has a side opening therethrough; and heat generated by said confined heating element is transferred to said heat conductive tubular member which transfers the heat to said heat conductive tube which transfers the heat to said plurality of heat radiating fins, said heat conductive tube and heat radiating fins radiating the heat to said environment through said side opening.

18. The heater as claimed in claim 11, wherein said means for radiating heat into the environment comprises:

first and second parallel heat conductive tubes; and a first plurality of heat radiating fins integrally cast with said first heat conductive tube, a first portion of said heating element arrangement being confined within said first heat conductive tube; and a second plurality of heat radiating fins integrally cast with said second heat conductive tube, a second portion of said heating element arrangement being confined within said second heat conductive tube.

19. The heater as claimed in claim 18, wherein:

said means for radiating heat into the environment comprises a plurality of spaced apart heat radiating connecting fins extending between and in thermal contact with each of said first and second conductive tubes.

20. The heater as claimed in claim 19, wherein said heat radiating fins extend from their corresponding heat conductive tubes to end at respective fin tips, and said heater unit further comprises:

an integrally formed heat conductive end strip arrangement joining said tips of said set of systematically organized heat radiating fins.

21. The heater as claimed in claim 19, wherein:

said heat conductive tubes, said heat radiating fins, said heat radiating connecting fins, and said heating element arrangement are of unitary, single cast, construction.

22. The heater as claimed in claim 18, wherein:

said first and second pluralities of heat radiating fins extend away from their respective heat conductive tubes to form an angle with one another, thereby defining a generally V-shaped profile.

* * * * *